US007015863B2

(12) United States Patent
Sadler et al.

(10) Patent No.: US 7,015,863 B2
(45) Date of Patent: Mar. 21, 2006

(54) MULTI-BAND, INVERTED-F ANTENNA WITH CAPACITIVELY CREATED RESONANCE, AND RADIO TERMINAL USING SAME

(75) Inventors: Robert A. Sadler, Raleigh, NC (US); Huan-Sheng Hwang, Cary, NC (US); Gerard James Hayes, Wake Forest, NC (US)

(73) Assignee: Sony Ericsson Mobile Communications AB, (SE)

( * ) Notice: Subject to any disclaimer, the term of this patent is extended or adjusted under 35 U.S.C. 154(b) by 472 days.

(21) Appl. No.: 10/248,082

(22) Filed: Dec. 17, 2002

(65) Prior Publication Data

US 2004/0198293 A1 Oct. 7, 2004

(51) Int. Cl.
*H01Q 1/24* (2006.01)
*H01Q 1/38* (2006.01)

(52) U.S. Cl. ..... 343/702; 343/700 MS; 343/845

(58) Field of Classification Search ..... 343/700 MS, 343/702, 833–834, 846, 848, 872–873, 895, 343/845; 455/550.1
See application file for complete search history.

(56) References Cited

U.S. PATENT DOCUMENTS 6,040,803 A * 3/2000 Spall ..... 343/700 MS
6,204,819 B1 * 3/2001 Hayes et al. ..... 343/702
6,229,487 B1 5/2001 Sadler et al. ..... 439/610
6,239,753 B1 * 5/2001 Kado et al. ..... 343/702
6,348,897 B1 * 2/2002 Alameh et al. ..... 343/702
6,380,903 B1 * 4/2002 Hayes et al. ..... 343/725
6,542,126 B1 * 4/2003 Bahr et al. ..... 343/702
6,650,294 B1 * 11/2003 Ying et al. ..... 343/700 MS
6,700,540 B1 * 3/2004 Holshouser ..... 343/700 MS
2002/0123312 A1 * 9/2002 Hayes et al. ..... 455/90

* cited by examiner

*Primary Examiner*—Thuy Vinh Tran
(74) *Attorney, Agent, or Firm*—Moore & Van Allen PLLC; Steven B. Phillips

(57) ABSTRACT

Multi-band, Inverted-F Antenna with capacitively created resonance, and radio terminal using same. The present invention creates an additional resonance frequency in a planar-style, inverted-F antenna (PIFA), such as that typically used in mobile radiotelephone or other types of radio terminals. A first radiating branch of the antenna is connected to the signal feed conductor and the ground feed conductor. A second radiating branch is connected to the signal feed conductor and the ground feed conductor at one end and is capacitively coupled to the first radiating branch at the other end so that the antenna resonates at an additional resonance frequency. The additional resonance frequency can be used for, among other things, adding GPS or Bluetooth functionality to a radiotelephone terminal that otherwise operates on GSM (Global System for Mobile) or other mobile radiotelephone terminal frequencies.

30 Claims, 6 Drawing Sheets

MULTI-BAND, INVERTED-F ANTENNA WITH CAPACITIVELY CREATED RESONANCE, AND RADIO TERMINAL USING SAME

BACKGROUND OF INVENTION

Terms such as radiotelephone, radiotelephone terminal, or mobile terminal, generally refer to communication terminals which provide a wireless communication link to a network, and thus to other radiotelephone terminals. This terminology most readily conjures images of "cellular" type mobile phones. However, the terminology may refer to radio terminals that are used in a variety of different applications, including land mobile, and satellite communication systems. Radiotelephone terminals typically include an antenna for transmitting and receiving wireless communication signals. Historically, monopole and dipole antennas have been employed in various radiotelephone terminal applications due to their simplicity, wide band response, broad radiation pattern, and low cost.

Miniaturization of the electronics for such terminals has increased interest in small antennas that can be internally mounted for use in radiotelephone terminals. Once such type of antenna is the planar, inverted-F antenna (PIFA) such as that illustrated in FIG. 1. In FIG. 1, illustrated antenna 100 includes linear conductive element 102 maintained in a spaced apart relationship with ground plane 104. Conventional inverted-F antennas, such as that illustrated in FIG. 1 derive their name from their resemblance to the letter "F". In FIG. 1, illustrated conductive element 102 is connected to the ground plane 104 as indicated at 106. A signal feed connection, 107, extends from underlying radio frequency circuitry through ground plane 104 to conductive element 102. An antenna like that illustrated in FIG. 1 typically resonates at a specific, narrow, frequency band. The resonance frequency of a PIFA can be broadened through the use of non-linear conductive elements. In such cases, the element is bent, curved, or formed, in some cases to meet the contours of the housing in which it is installed. By adjusting the width and length of the various segments of a non-linear conductive element, the resonance frequency of the antenna can be broadened and adjusted.

It should be noted that it has also become desirable for radiotelephone terminals to be able to operate within multiple frequency bands in order to use more than one communication network. For example GSM (Global System for Mobile) is a digital radiotelephone system that operates from 880 MHz to 960 MHz in many countries, at 1,710 MHz to 1,880 MHz in still other countries, and at 1,850 MHz to 1,990 MHz in still other countries. Multi-band operation for a non-linear, planar inverted-F antenna can be achieved for such systems by making the resonance frequencies broad, and by forming a radiating branch from segments that cause the antenna to radiate efficiently in at least two, broad bands. However, if there is a desire to add additional frequency bands, it is usually necessary to add an additional antenna. This may be the case when it is desirable to combine a radiotelephone terminal with global positioning system (GPS) function, wherein the GPS frequency is approximately 1,575 MHz. Another example would be the case where (Bluetooth) short range wireless functionality is desired. Bluetooth operates at approximately 2,400 MHz. In the current art, GPS or Bluetooth functionality typically requires an additional antenna.

SUMMARY OF INVENTION

The present invention creates an additional resonance frequency in a planar style, inverted-F antenna, such as that typically used in mobile or radiotelephone terminals. The additional resonance frequency can be added to an antenna regardless of how many base resonance frequencies the antenna is designed for. For example, a single-band antenna can be made into a dual-band antenna, a dual-band antenna can be made into a tri-band antenna, a tri-band antenna can have an additional resonance frequency added to effectively become a four-band antenna. Thus, the invention allows a single antenna to achieve an additional resonance even where the resonance could not be achieved by otherwise broadening the response of the antenna, or causing the antenna to operate efficiently at additional "base frequency" bands, for example, by merely adding or altering segments. Throughout this disclosure, the term base frequency is used to refer to any and all frequency resonances that an antenna would possess in the absence of employing the invention.

According to at least some embodiments of the invention, an inverted-F antenna includes a signal feed conductor and a ground feed conductor. A first radiating branch of the antenna is connected to the signal feed conductor and the ground feed conductor. This first radiating branch may be non-linear and contain multiple segments. A second radiating branch has a first end which is connected to the signal feed conductor and the ground feed conductor, essentially co-terminous with the first branch, and a second end which is capacitively coupled to the first radiating branch so that the antenna resonates at an additional resonance frequency. The additional resonance frequency is at least in part dependent on the degree of capacitive coupling between the first radiating branch and the second radiating branch. For example, when used in a radiotelephone terminal of the "cellular" type, for example, an antenna system designed primarily to radiate in one or both of the allocated communication bands from roughly 880 to 960 MHz and 1,710 to 1,990 MHz, can be made to resonate at the additional resonance frequency allocated for GPS or Bluetooth, namely 1,575 MHz or 2,400 MHz.

The capacitive coupling between the second end of the second radiating branch of the antenna and the first radiating branch of the antenna can be achieved in a number of ways. For example, the second radiating branch can overlap or underlap the first radiating branch, with the amount and spacing of the overlap or underlap being controlled to tune the desired additional resonance frequency. Additionally, a parasitic element that overlaps or underlaps both radiating branches can be added. Another way to create the capacitive coupling is to form an extended coupling area at the second end of the second radiating branch. This extended coupling area's edge runs parallel and in substantially close proximity to the first radiating branch to create the capacitive coupling.

An inverted-F antenna according to the invention is assembled into a radiotelephone terminal with an internal ground plane and transceiver components operable to transmit and receive radiotelephone communication signals. The antenna is disposed substantially parallel to the ground plane and is connected to the ground plane and the transceiver components. The antenna may be formed or shaped to conform to the shape of the radiotelephone terminal housing. Thus, the antenna may not be strictly "planar" although in the vernacular of the art, it might still be referred to as a planar inverted-F antenna. The antenna can be fashioned either by metal stamping, or by forming the antenna on a flex film substrate. Once the ground plane and antenna are formed and the transceiver components are assembled, the radiotelephone terminal apparatus can be enclosed in the appropriate housing to make a finished product.

DETAILED DESCRIPTION

Figure 1:
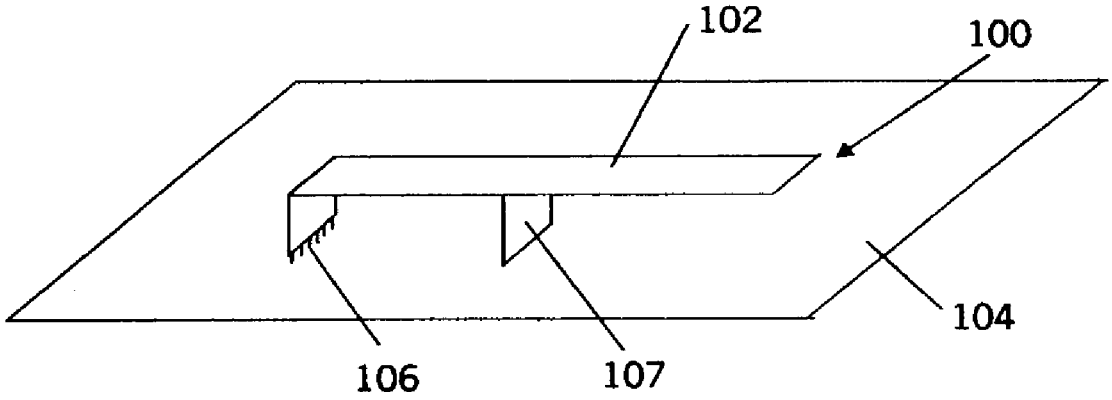
FIG. 1 Prior Art
FIG. 1 is an illustration of a planar inverted-F antenna of the prior art.

The present invention will now be described more fully with reference to the accompanying drawings, in which specific embodiments of the invention are shown. The invention may, however, be embodied in many different forms and should not be construed as limited to the specific embodiments herein. In the drawings, the thickness of various structures, such as portions of the radiating branches of an antenna, may be exaggerated for illustration, or not shown at all in cases where the clarity of the other aspects of the drawing is important to understanding the invention. Also, like numbers refer to like elements throughout the description of the drawings. Finally, the type of internal antenna being discussed is based on, and often referred to as a "planar" inverted-F antenna. It should be noted that in at least some cases, the illustrated embodiments do not show a strictly "planar" antenna. In these cases, a theoretically planar antenna has been deformed, bent, or otherwise distorted in order to conform to the housing in which it is to be enclosed, account for the positioning of electronic components, or tune the antenna most effectively. Notwithstanding any of the above, the antenna may still be referred to as a planar inverted-F antenna or simply an inverted-F antenna.

It must also be noted that the antennas shown in the example embodiments herein, being for specific frequency bands, are shown as an example only. The inventive concepts herein can be readily applied by those of ordinary skill in the art to an antenna used for any combination of frequency bands allocated for any purposes, either much higher or lower in frequency than the radiotelephone and other frequency bands discussed herein.

Figure 2A:
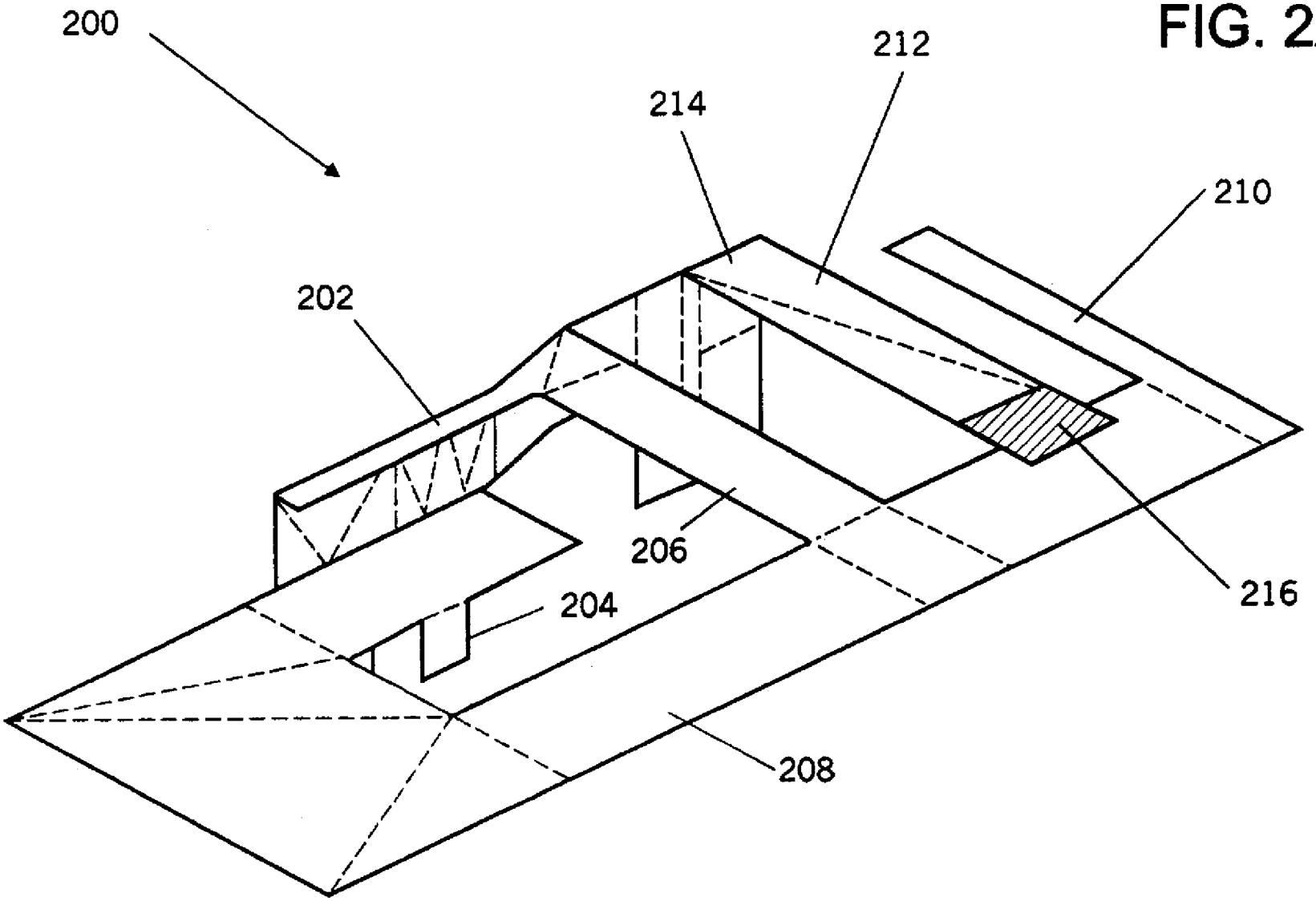
FIG. 2 illustrates two different external views of an inverted-F antenna according to some embodiments of the present invention. The two views are shown separately in FIGS. 2A and 2B.

Turning to FIG. 2, FIG. 2A illustrates one view of an inverted-F antenna according to some embodiments of the present invention. The ground plane is omitted for clarity. Antenna 200 includes an area, 202, where a signal feed conductor and a ground feed conductor are attached. Signal feed conductor 204 is visible. A first radiating branch is comprised of multiple segments. Segment 206 connects the first radiating branch to the signal feed conductor and ground feed conductor. The first radiating branch also includes segment 208 and segment 210. This first radiating branch tends to create one base resonance at a fundamental frequency, roughly in the 900 MHz range, useful for certain GSM systems. In this particular embodiment, the antenna has a second base resonance frequency at approximately 1,900 MHz. The bandwidth of the antenna in this area is great enough to accommodate both the 1,900 MHz GSM band and the 1,800 MHz GSM band.

In the embodiment of FIG. 2, the antenna includes a second radiating branch 212 which has a first end, 214, which is connected to the signal feed conductor and ground feed conductor approximately in area 202 where the first radiating branch is connected. Second radiating branch 212, however, includes a second end 216, which capacitively couples the second radiating branch to the first radiating branch. The capacitive coupling can be adjusted to create an additional resonance. In this particular example, the additional resonance is for the global positioning system (GPS) as the terminal into which this antenna is to be built, will include a GPS receiver. GPS operates at approximately 1,575 MHz. GPS is well-known to those skilled in the art. GPS is a space-based triangulation system using satellites and computers to measure positions anywhere on the earth. Compared to other land-based systems, GPS is less limited in its coverage, typically provides continuous twenty-four hour coverage regardless of weather conditions, and is highly accurate. In the current implementation, a constellation of twenty-four satellites orbiting the earth continually emit the GPS radio frequency. The additional resonance of the antenna as described above permits the antenna to be used to receive these GPS signals.

In FIG. 2, the capacitive coupling between the first branch and the second branch of the antenna is created by an overlapping area, shown in crosshatch. An underlapping area can be used and would work in the same way. However, whether an area is overlapping or underlapping depends on the point of view. If the antenna of FIG. 2 is turned over, the overlapping portion of the second radiating branch as shown becomes an underlapping portion. In recognition of this fact the term "overlap" or "overlapping" as used in this disclosure can refer to either overlapping or underlapping areas in a particular point of view. To a first approximation, a parallel plate capacitor is formed at the overlapping or underlapping area. The amount of capacitance, and hence the amount of coupling and the additional resonance frequency, can be controlled by controlling the distance between the branches in the crosshatched area, and the size of the area. This control, in effect, manipulates variables in the formula that is well-known for parallel plate capacitors:

$$C = \frac{\varepsilon_0 A}{d},$$

where C is the capacitance in Farads, A is the area of the plates, corresponding to the overlap/underlap area, d is the distance between the plates, corresponding to the distance between the first and second radiating branches, and $\epsilon_0$ is the permittivity constant.

Figure 2B:
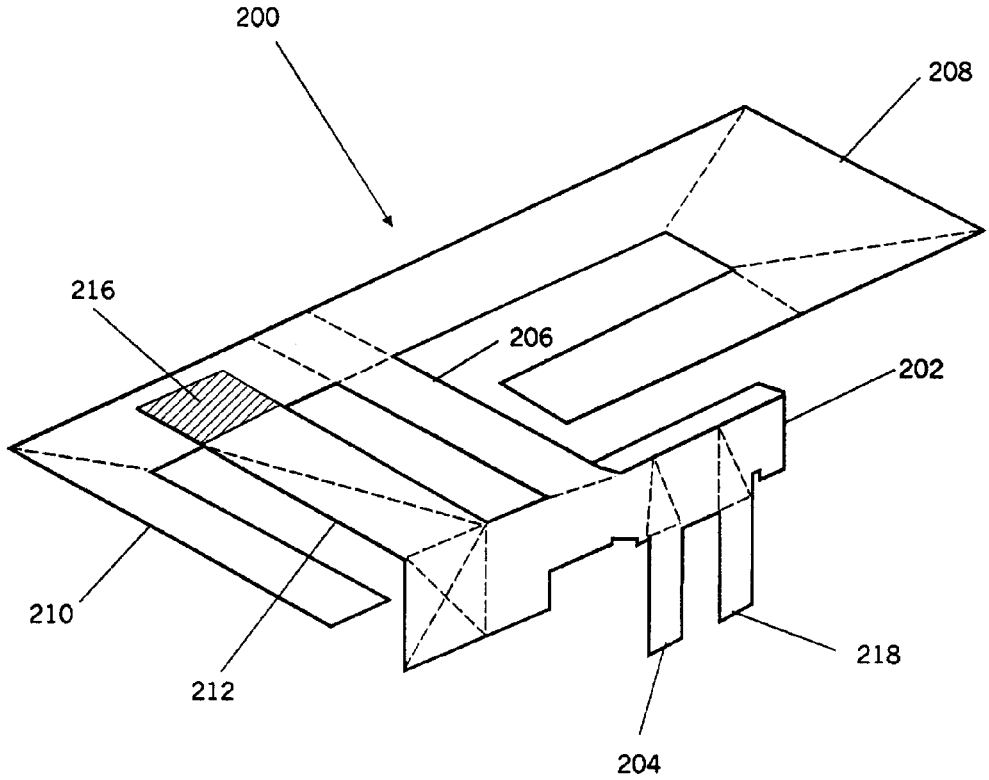

FIG. 2B illustrates the same PIFA as in FIG. 2A, but this time from a different angle. Again, like reference numbers refer to like structures in this view. This view also displays the overlap of the crosshatched area at the second end 216 of the second radiating branch of the antenna. Additionally, in this view, signal feed conductor 204 is more visible and ground feed conductor 218 is visible. It will be appreciated by those of skill in the art that the signal feed and ground feed conductors can vary in length and differ from each other in length, dependent on the physical characteristics of the radio device in which the antenna is being used. Again, although in this example the second radiating branch is overlapping the first radiating branch, the same effect could be achieved by having the second radiating branch "underlap" the first radiating branch. Again, the term "overlap" if used by itself in this disclosure is intended to encompass both possibilities.

Figure 3:
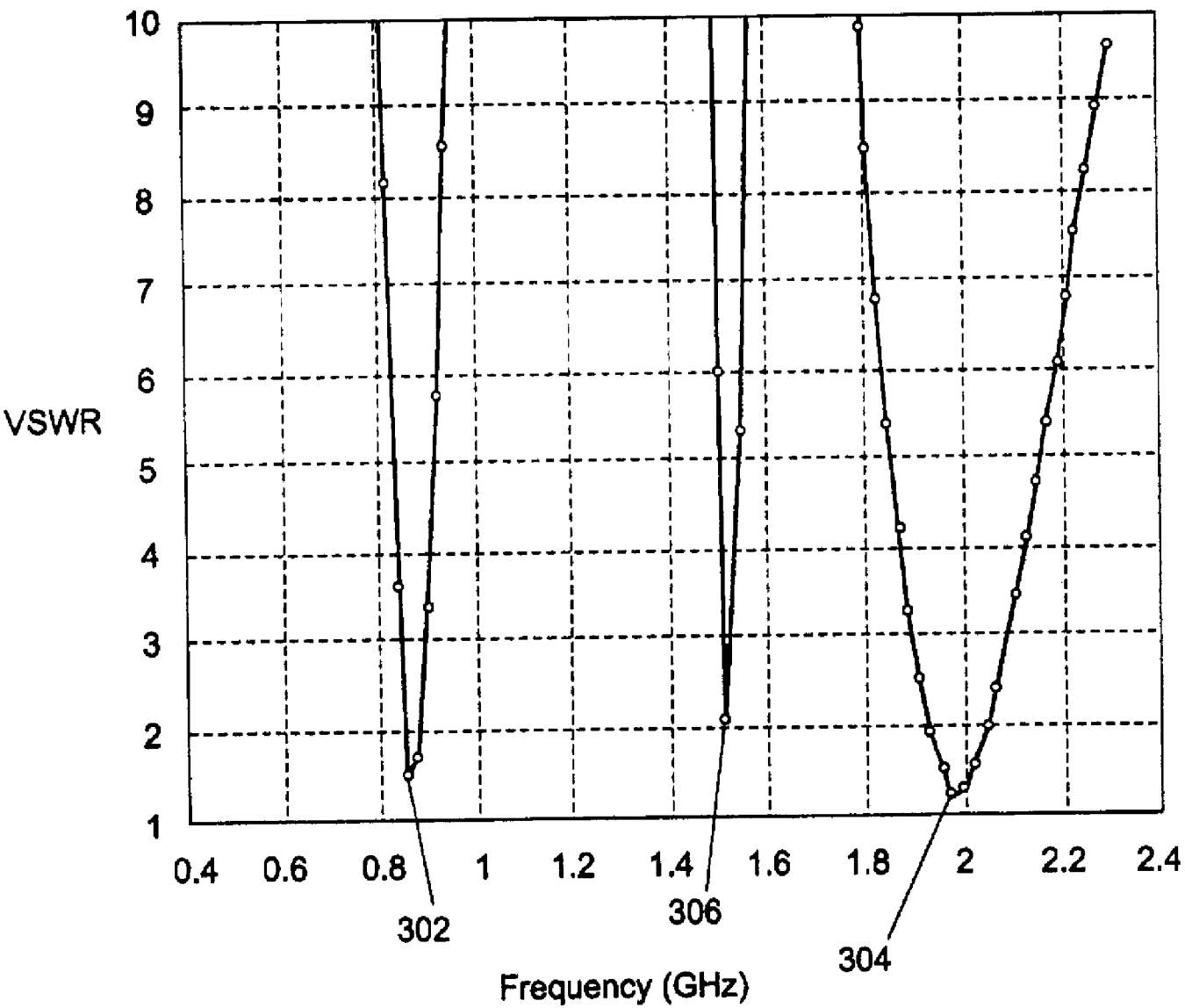
FIG. 3 is a voltage standing wave ratio chart illustrating the frequency resonances of the antenna of FIG. 2.

FIG. 3 is a graph illustrating the voltage standing wave ratio (VSWR) for the antenna illustrated in FIG. 2 as a function of frequency. VSWR charts such as that illustrated in FIG. 3 are well understood in the art, and so an extensive explanation of the meaning of this chart is not needed. However, it should be noted that the antenna of FIG. 2 has three resonance frequencies, each clearly visible as a local minimum in the VSWR curve. This particular antenna has two base resonance frequencies as previously mentioned, occurring at approximately 900 MHz and 1,900 MHz, 302 and 304, respectively. The additional resonance is for 1,575 MHz, and is visible as the local minimum shown at 306.

Figure 4:
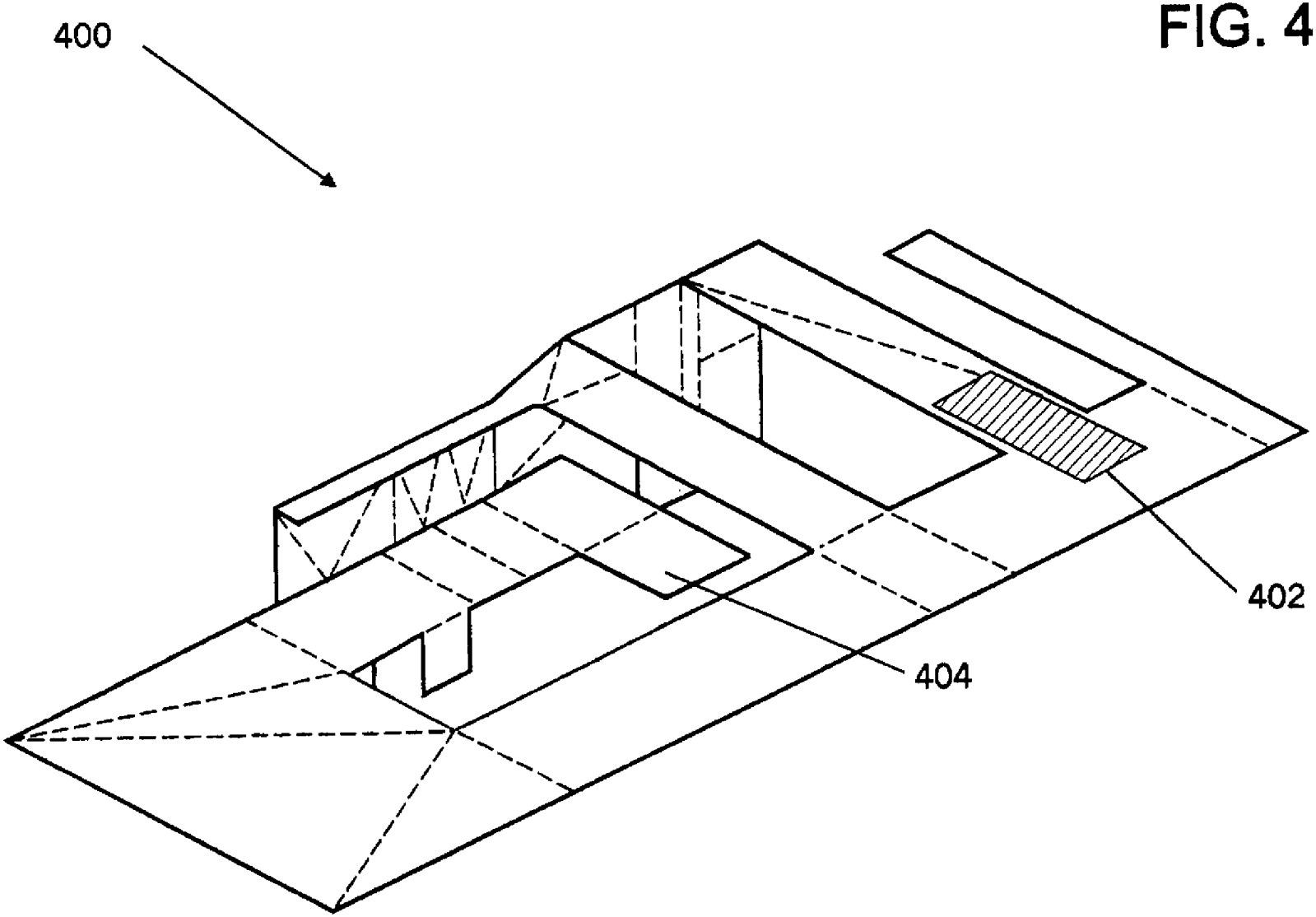
FIG. 4 is a view of an antenna according to other embodiments of the present invention.

FIG. 4 is a single view of another embodiment of an antenna, 400, according to the invention. The antenna of FIG. 4 is identical in many structural respects to the antenna of FIG. 2, therefore, most of the structural aspects have not been highlighted by reference numbers or described. However, there are two readily visible differences between the antenna of FIG. 2 and the antenna of FIG. 4. Firstly, capacitive coupling between the first radiating branch and the second radiating branch is now achieved by a separate parasitic conductor, 402, which may be installed with adhesive or otherwise structurally supported by the housing of the radiotelephone terminal. Again, this parasitic could be either over or under the radiating branches as shown in this view, and in either case it may be referred to as "over" or "overlapping". The parasitic does not have to be rectangular, but could vary in shape as well as size. Essentially all of the parasitic area, with the exception of the portion that falls directly over the small space between the two radiating branches is capacitively coupled with one or the other of the two branches, as the case may be. Again, the area of capacitive coupling and the distance between the parasitic and the branches can be adjusted to tune the additional resonance, based on the formula previously discussed, except that a designer is essentially dealing with two capacitors in series. In this particular design, an extra extension, 404, had to be added to the first radiating branch to achieve appropriate resonances. This extension may or may not be necessary in any particular case, depending on the overall shape and bends of the inverted-F antenna and the particular application. It is easily within the capabilities of one of ordinary skill in the art to experimentally tune such an antenna for a particular application in question.

Figure 5:
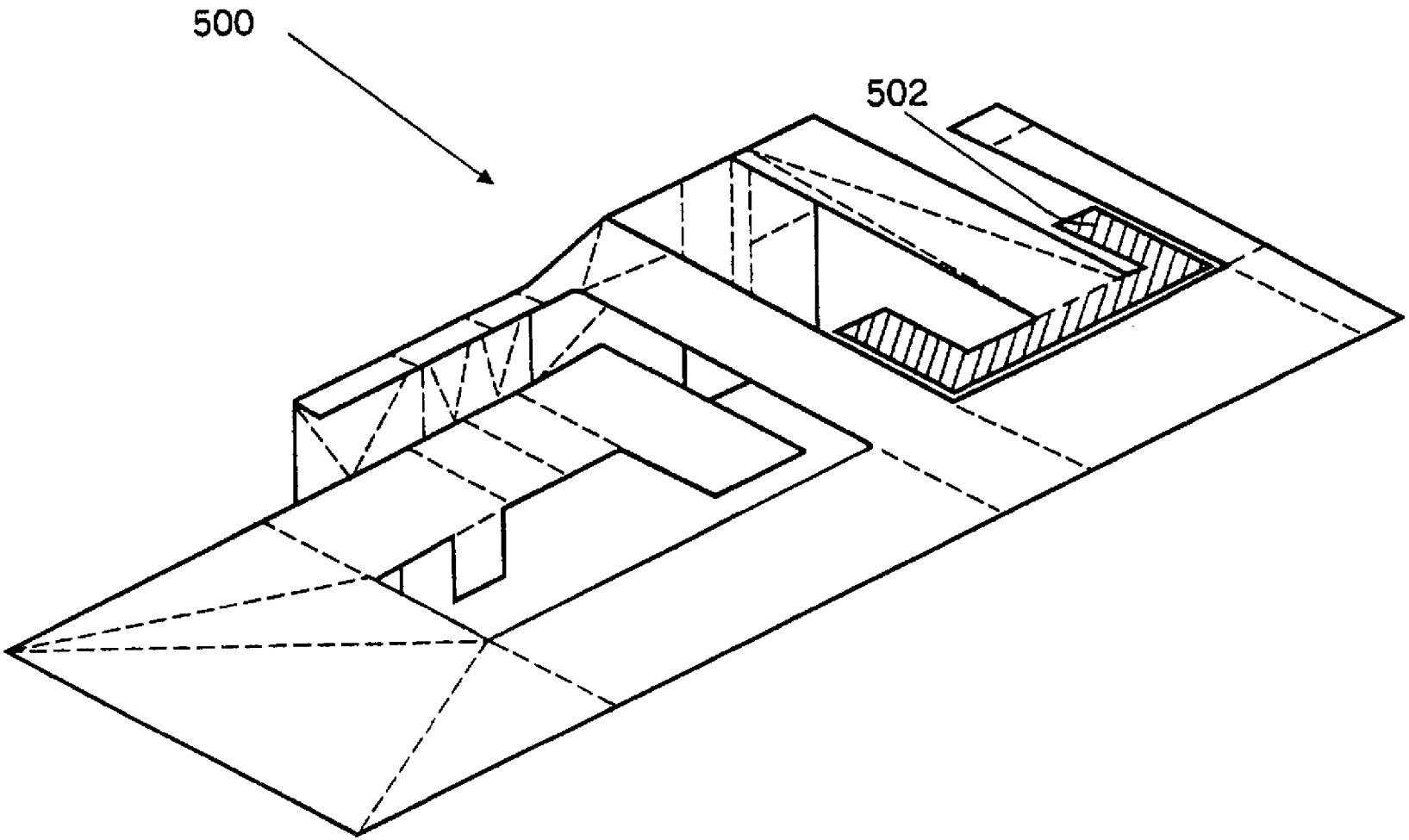
FIG. 5 is an illustration of an antenna according to still other embodiments of the invention.

FIG. 5 illustrates another embodiment of an antenna, 500, according to the invention. In FIG. 5 a U-shaped extension, 502, is attached to the second radiating branch. This U-shaped extension creates an extended coupling area, shown in crosshatch, for the second radiating branch whose edge runs parallel to and in substantially close proximity to the first radiating branch. This pattern creates an area of capacitive coupling involving areas of the two radiating branches. It will be appreciated by those of skill in the art that this, in effect, creates a parallel plate capacitor "on its side" in which the thickness of the conductors of the antenna multiplied by the length of adjacency effectively defines the area of the capacitor, for application via the formula previously described. It must be noted that this particular extension to the second radiating branch is shown by way of example only. It is entirely possible to devise an antenna with radiating branches of other irregular shapes which cause specific areas of the edges of the radiating branches to come in close proximity to each other for particular distances along the edges.

Figure 6:
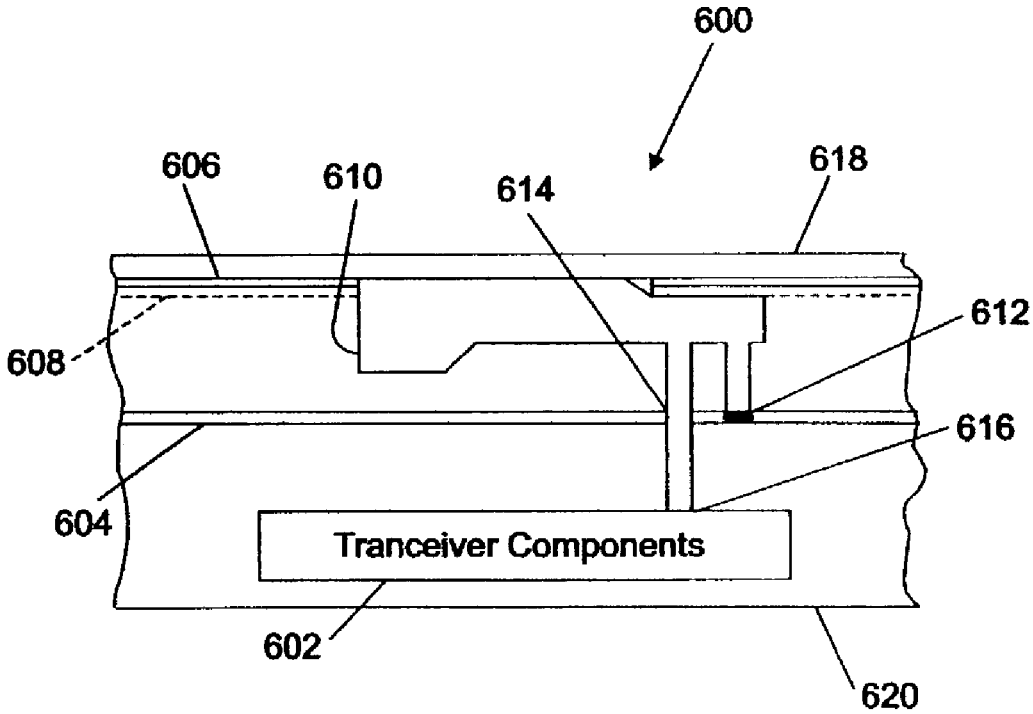
FIG. 6 is a functional diagram, which illustrates how an antenna according to some embodiments of the invention is built into a radiotelephone terminal.

FIG. 6 is a functional, schematic illustration of a radiotelephone type radio terminal of the cellular or PCS type, which makes use of an antenna according to embodiments of the present invention. FIG. 6 illustrates a close-up view in which the housing is presented with a "see-through" side. FIG. 6 also serves to illustrate a method of assembling a radiotelephone terminal using an antenna of the invention. In FIG. 6, radiotelephone terminal 600 includes electronic transceiver components 602, shown schematically, which are assembled in the traditional fashion. Ground plane 604 serves as the ground plane for the planar inverted-F antenna, 606. This PIFA is fashioned by stamping metal, or alternatively by formation on a flex-film substrate, which, since it is optional, is illustrated schematically by a dotted line as shown at 608. Antenna 606 includes area 610 which serves to connect the radiating branches to the signal and ground feed conductors. The ground feed conductor is connected to the ground plane at 612. The antenna is installed substantially parallel to the ground plane, subject to distortions and curvatures as might be present for the particular application, as previously discussed. The signal feed conductor passes through an aperture in the ground plane at 614 and is connected to the transceiver components, 602, at interface 616. Finally, the transceiver components, the ground plane, and the inverted-F antenna are enclosed in the housing for the radiotelephone terminal. The housing includes back portion 618 and front portion 620. Steps involved in assembling a terminal using an antenna according to the invention might be performed in any of various orders, depending on the manufacturing processes involved. It is understood that radiotelephone terminal 600 of FIG. 6 includes other conventional components such as a keypad, and display. The transceiver components, 602, not only include a radio frequency block, but a processor, memory, and other components typically associated with the functions of such a device.

It must be emphasized that although embodiments of the antenna of the present invention have been illustrated in the context of a radiotelephone terminal, that the antenna can also be used in a separate receiver or a separate transmitter, which might also in some circles be referred to as a radio terminal. Additionally, a modern radiotelephone terminal is typically envisioned as a duplex device. An antenna according to the invention could find use in a simplex device, such as a two-way radio with a push-to-talk function. In such a case, the antenna provides an additional resonance for another band of operation, even if the band is purely for receive, or purely for transmit. For example, the additional resonance could be used to receive weather band broadcasts on a radio designed for two-way communication in some specific base frequency band that is allocated for emergency services or the like.

It should be pointed out that references may be made in this disclosure to figures and descriptions using terms such as "top", "bottom", "edge", "inner", "outer", etc. These terms are used merely for convenience and refer only to the relative position of features as shown from the perspective of the reader, assuming an operation orientation for convenience herein.

Additionally, even in the context of a radiotelephone terminal, or a "mobile terminal" similar to a traditional "cellular" telephone, as used herein, such terms are synonymous with and may include: a cellular radiotelephone with or without a multi-line display; a personal communication system (PCS) terminal; a radiotelephone combined with data processing, facsimile, and data communication capabilities; a personal data assistant (PDA) that can include a radio telephone, pager, Internet access, web browser, or organizer; and a conventional laptop or palmtop computer or other appliance that includes a radiotelephone transceiver. The term radiotelephone terminal is also intended to encompass so-called "pervasive computing" devices which include two-way radio communication capabilities.

Specific embodiments of an invention are described herein. One of ordinary skill in the telecommunications and antenna arts will quickly recognize that the invention has other applications in other environments. Many embodiments are possible, and the following claims are in no way intended to limit the scope of the invention to the specific embodiments described above.

The invention claimed is:

1. An inverted-F antenna comprising:

a signal feed conductor;

a ground feed conductor;

a first radiating branch connected to the signal feed conductor and the ground feed conductor; and a second radiating branch having a first end which is connected to the signal feed conductor and the ground feed conductor aproximately where the first radiating branch is connected to the signal feed conductor and the ground feed conductor, and a second end which is capacitively coupled to the first radiating branch so that the inverted-F antenna exhibits at least one base resonance frequency and an additional resonance frequency, wherein the additional resonance frequency is at least in part dependent on a degree of capacitive coupling between the first radiating branch and the second radiating branch.

2. The inverted-F antenna of claim 1 wherein the second end of the second radiating branch further comprises an overlapping area, which overlaps the first radiating branch to create the capacitive coupling between the first radiating branch and the second radiating branch.

3. The inverted-F antenna of claim 2 wherein the at least one base resonance frequency is from a frequency band that is allocated for radiotelephone communications, and the additional resonance frequency is approximately 1575 MHz.

4. The inverted-F antenna of claim 2 wherein the at least one base resonance frequency is from a frequency band that is allocated for radiotelephone communications, and the additional resonance frequency is approximately 2400 MHz.

5. The inverted-F antenna of claim 2 further comprising a parasitic element which overlaps the first radiating branch and the second radiating branch to create the capacitive coupling between the first radiating branch and the second radiating branch.

6. The inverted-F antenna of claim 3 wherein the at least one base resonance frequency is from a frequency band that is allocated for radiotelephone communications, and the additional resonance frequency is approximately 1575 MHz.

7. The inverted-F antenna of claim 3 wherein the at least one base resonance frequency is from a frequency band that is allocated for radiotelephone communications, and the additional resonance frequency is approximately 2400 MHz.

8. The inverted-F antenna of claim 1 wherein the second end of the second radiating branch further comprises an extended coupling area whose edge runs parallel and in substantially close proximity to the first radiating branch to create the capacitive coupling between the first radiating branch and the second radiating branch.

9. The inverted-F antenna of claim 8 wherein the at least one base resonance frequency is from a frequency band that is allocated for radiotelephone communications, and the additional resonance frequency is approximately 1575 MHz.

10. The inverted-F antenna of claim 8 wherein the at least one base resonance frequency is from a frequency band that is allocated for radiotelephone communications, and the additional resonance frequency is approximately 2400 MHz.

11. The inverted-F antenna of claim 1 wherein the at least one base resonance frequency is from a frequency band tat is allocated for radiotelephone communications, and the additional resonance frequency is approximately 1575 MHz.

12. The inverted-F antenna of claim 1 wherein the at least one base resonance frequency is from a frequency band that is allocated for radiotelephone communications, and the additional resonance frequency is approximately 2400 MHz.

13. A radiotelephone terminal comprising:

an internal ground plane;

transceiver components operable to transmit and receive radiotelephone communication signals; and an antenna disposed substantially parallel to the ground plane and connected to the ground plane and the transceiver components, the antenna comprising:

a first radiating branch connected to the ground plane and transceiver components; and a second radiating branch having a first end which is connected to the ground plane and transceiver components approximately where the first radiating branch is connected to the ground plane and the transceiver components, and a second end which is capacitively coupled to the first radiating branch so that the antenna exhibits at least one base resonance frequency and an additional resonance frequency, wherein the additional resonance frequency is at least in part dependent on a degree of capacitive coupling between the first radiating branch and the second radiating branch.

14. The radiotelephone terminal of claim 13 wherein the second end of the second radiating branch of the antenna further comprises an overlapping area, which overlaps the first radiating branch of the antenna to create the capacitive coupling between the first radiating branch and the second radiating branch.

15. The radiotelephone terminal of claim 14 wherein the additional resonance frequency is a frequency used by a global positioning system (GPS).

16. The radiotelephone terminal of claim 14 wherein the additional resonance frequency is used for Bluetooth messaging.

17. The radiotelephone terminal of claim 13 wherein the antenna further comprises a parasitic element which overlaps the first radiating branch and the second radiating branch to create the capacitive coupling between the first radiating branch and the second radiating branch.

18. The radiotelephone terminal of claim 17 wherein the additional resonance frequency is a frequency used by a global positioning system (GPS).

19. The radiotelephone terminal of claim 17 wherein the additional resonance frequency is used fix Bluetooth messaging.

20. The radiotelephone terminal of claim 13 wherein the second end of the second radiating branch of the antenna further comprises an extended coupling area whose edge runs parallel and in substantially close proximity to the first radiating branch of the antenna to create the capacitive coupling between the first radiating branch and the second radiating branch.

21. The radiotelephone terminal of claim 20 wherein the additional resonance frequency is a frequency used by a global positioning system (GPS).

22. The radiotelephone terminal of claim 20 wherein the additional resonance frequency is used for Bluetooth messaging.

23. The radiotelephone terminal of claim 13 wherein the additional resonance frequency is a frequency used by a global positioning system (GPS).

24. The radiotelephone terminal of claim 13 wherein to additional resonance frequency is used for Bluetooth messaging.

25. A method of assembling a radiotelephone terminal having an inverted-F antenna, the method comprising:

assembling transceiver components;

forming a ground plane;

fashioning the inverted-F antenna comprising a first radiating branch for connection to the transceiver components and the around plane and a second radiating branch, the second radiating branch having a first end for connection to the transceiver components and the ground plane and a second end which is capacitively coupled to the first radiating branch so that the antenna exhibits at least one base resonance frequency and an additional resonance frequency, wherein the additional resonance frequency is at least in part dependent on a degree of capacitive coupling between the first radiating branch and the second radiating branch;

connecting the inverted-F antenna to the transceiver components and the ground plane so that the first end of the second radiating branch is connected to the transceiver components and the ground plane approximately where the first radiating branch is connected to the transceiver components and the ground plane; and enclosing the transceiver components, the ground plane and the inverted-F antenna in a housing.

26. The method of claim 25 wherein the fashioning of the inverted-F antenna further comprises stamping the inverted-F antenna.

27. The method of claim 26 wherein the fashioning of the inverted-F antenna further comprises attaching a parasitic element to the inverted F antenna wherein the parasitic element overlaps the first radiating branch and the second radiating branch to create the capacitive coupling between the first radiating branch and the second radiating branch.

28. The method of claim 25 wherein the fashioning of the inverted-F antenna further comprises forming the inverted-F antenna on a flex film substrate.

29. The method of claim 28 wherein the fashioning of the inverted-F antenna further comprises attaching a parasitic element to the inverted F antenna wherein the parasitic element overlaps the first radiating branch and the second radiating branch to create the capacitive coupling between the first radiating branch and the second radiating branch.

30. The method of claim 25 wherein the fashioning of the inverted-F antenna further comprises attaching a parasitic element to the inverted F antenna wherein the parasitic element overlaps the first radiating branch and the second radiating branch to create the capacitive coupling between the first radiating branch and the second radiating branch.

* * * * *

UNITED STATES PATENT AND TRADEMARK OFFICE

CERTIFICATE OF CORRECTION

PATENT NO. : 7,015,863 B2
DATED : March 21, 2006
INVENTOR(S) : Robert Anthony Sadler It is certified that error appears in the above-identified patent and that said Letters Patent is hereby corrected as shown below:

Column 7,
Line 26, delete “aproximately” and insert -- approximately --;
Line 49, delete “2” and insert -- 1 --;
Lines 54 and 58, delete “3” and insert -- 5 --;

Column 8,
Line 10, delete “tat” and insert -- that --;
Line 59, delete “fix” and insert -- for --; and Column 9,
Line 10, delete “to” and insert -- the --.

Signed and Sealed this

Ninth Day of May, 2006

JON W. DUDAS
*Director of the United States Patent and Trademark Office*